US010231542B2

(12) United States Patent
Wang et al.

(10) Patent No.: US 10,231,542 B2
(45) Date of Patent: Mar. 19, 2019

(54) DOMED FELT FURNITURE SLIDER

(71) Applicants: Tianzhe Wang, Shaker Hts., OH (US); Jason Sharratt, Seville, OH (US); Andrew Byron Logar, Willowick, OH (US)

(72) Inventors: Tianzhe Wang, Shaker Hts., OH (US); Jason Sharratt, Seville, OH (US); Andrew Byron Logar, Willowick, OH (US)

(73) Assignee: Waxman Consumer Products Group Inc., Bedford Heights, OH (US)

( * ) Notice: Subject to any disclaimer, the term of this patent is extended or adjusted under 35 U.S.C. 154(b) by 0 days.

(21) Appl. No.: 15/805,440

(22) Filed: Nov. 7, 2017

(65) Prior Publication Data

US 2018/0160810 A1 Jun. 14, 2018

Related U.S. Application Data

(60) Provisional application No. 62/433,932, filed on Dec. 14, 2016.

(51) Int. Cl.
*A47B 91/06* (2006.01)
*A47B 91/12* (2006.01)

(52) U.S. Cl.
CPC ..... *A47B 91/06* (2013.01); *A47B 91/12* (2013.01); *A47B 2091/063* (2013.01)

(58) Field of Classification Search
CPC ..... A47B 91/00; A47B 91/02; A47B 91/12; A47B 91/14; A47B 91/16; A47B 91/06; A47B 2091/063; B60B 33/00; B60B 2033/0034; B60B 2900/5112; B65G 7/02; A47C 7/002; A47C 7/008; A61H 3/0288; A61H 3/068; Y10T 16/207; Y10T 16/209; Y10T 16/211; Y10T 16/21; Y10T 16/216
See application file for complete search history.

(56) References Cited

U.S. PATENT DOCUMENTS 710,073 A * 9/1902 Pratt et al. ..... A47C 7/002 135/86
1,903,609 A * 4/1933 Uhl ..... A47B 91/04 16/42 R
3,326,508 A * 6/1967 Born ..... A47B 91/06 16/42 R
3,592,423 A * 7/1971 Mui ..... F16F 1/3615 248/188.4

(Continued)

FOREIGN PATENT DOCUMENTS

GB 984601 A * 2/1965 ..... A47B 91/06

*Primary Examiner* — Chuck Y Mah
(74) *Attorney, Agent, or Firm* — Fay Sharpe LLP

(57) ABSTRACT

A furniture pad including a body having a floor engaging surface portion and a peripheral edge portion at least partially surrounding the floor engaging surface portion. The peripheral edge portion has a first density and the floor engaging surface portion has a second density, the first density being greater than the second density. The peripheral edge portion extends away from the floor engaging surface portion such that the peripheral edge portion does not contact an associated supporting surface when the floor engaging surface portion is in contact with the associated supporting surface, whereby the peripheral edge portion has a relatively more durable surface as compared to the floor engaging surface portion.

8 Claims, 3 Drawing Sheets

(56) References Cited

U.S. PATENT DOCUMENTS

| | | | | |
|---|---|---|---|---|
| 5,081,740 | A * | 1/1992 | Smith | A47B 91/06 16/42 R |
| 5,220,705 | A | 6/1993 | Bushey | |
| 5,426,818 | A | 6/1995 | Bushey | |
| 5,557,824 | A | 9/1996 | Bushey | |
| 6,324,725 | B1 * | 12/2001 | Green | A47B 91/06 16/42 R |
| 6,405,982 | B2 * | 6/2002 | Ferencz | A47B 91/06 16/42 R |
| 2004/0123421 | A1 * | 7/2004 | Bushey | A47B 91/06 16/17.1 |
| 2005/0003723 | A1 * | 1/2005 | Brouard | A47B 91/06 442/86 |
| 2005/0034268 | A1 * | 2/2005 | Wurdack | A47B 91/002 16/42 R |
| 2005/0081330 | A1 * | 4/2005 | Edwards | A47B 91/06 16/42 R |
| 2005/0084646 | A1 * | 4/2005 | Edwards | A47B 91/06 428/95 |
| 2005/0183234 | A1 * | 8/2005 | Bushey | A47B 91/06 16/42 R |
| 2006/0016949 | A1 * | 1/2006 | Payne | A47B 91/00 248/346.01 |
| 2007/0186374 | A1 | 8/2007 | Thaw et al. | |
| 2008/0042025 | A1 * | 2/2008 | Brouard | A47B 91/06 248/188.9 |
| 2008/0258023 | A1 * | 10/2008 | Desmarais | A47B 91/12 248/188.9 |
| 2008/0280102 | A1 * | 11/2008 | Brouard | A47B 91/06 428/141 |
| 2010/0018005 | A1 * | 1/2010 | Bushey | A47B 91/06 16/42 T |
| 2012/0047688 | A1 * | 3/2012 | Belec | A47B 91/06 16/42 R |
| 2016/0157608 | A1 | 6/2016 | Gergonne et al. | |

* cited by examiner

DOMED FELT FURNITURE SLIDER

CROSS REFERENCE TO RELATED PATENTS AND APPLICATIONS

This application claims priority to and the benefit of the filing date of U.S. Provisional Patent Application Ser. No. 62/433,932, filed Dec. 14, 2016, which application is hereby incorporated by reference.

TECHNICAL FIELD

The present exemplary embodiment relates to pads for furniture. It finds particular application in conjunction with pads intended to protect flooring against furniture and appliance movement, in residential, commercial and/or industrial environments and will be described with particular reference thereto. However, it is to be appreciated that the present exemplary embodiment is also amenable to other like applications.

BACKGROUND

Furniture pads are often used for floor protection and/or to facilitate sliding of furniture over the floor. One type of furniture pad is primarily composed of felt, and may be adhered or otherwise secured to furniture feet/legs to protect the floor and/or facilitate sliding of the furniture. Such sliders are typically punched out from a sheet of felt.

In the past, felt sliders have suffered from wear and tear during use, particular on peripheral edges thereof (e.g., the cut edges) due to impact with and/or abrasion against floor transitions and other obstacles.

BRIEF DESCRIPTION

In certain examples, a furniture pad is disclosed having a densified peripheral edge portion that increases durability of the furniture pad as compared to furniture pads not having a densified peripheral edge portion.

In accordance with one aspect of the present exemplary embodiment, a furniture pad and method of making the same, for use between a support member of an associated furniture item and an associated supporting surface, comprises a body having a floor engaging surface portion for engaging the associated supporting surface, and a peripheral edge portion at least partially surrounding the floor engaging surface portion, the peripheral edge portion having a first density and the floor engaging surface portion having a second density, the first density being greater than the second density. The peripheral edge portion extends away from the floor engaging surface portion such that the peripheral edge portion does not contact the associated supporting surface when the floor engaging surface portion is in contact with the associated supporting surface, whereby the peripheral edge portion has a relatively more durable surface as compared to the floor engaging surface portion.

At least a portion of the peripheral edge portion can be convex. The body can be composed of a unitary piece of felt having said first and second densities. The felt body can be composed of, for example, 100% polyester, 7 mm thick central portion, density of 0.032 g/cm$^3$. The pad can further comprise a foam pad secured to the body on an opposite side than the floor engaging surface portion. The peripheral edge portion can be heat treated. The peripheral edge portion can be more than twice as dense as the floor engaging surface portion.

DETAILED DESCRIPTION

Figure 1:
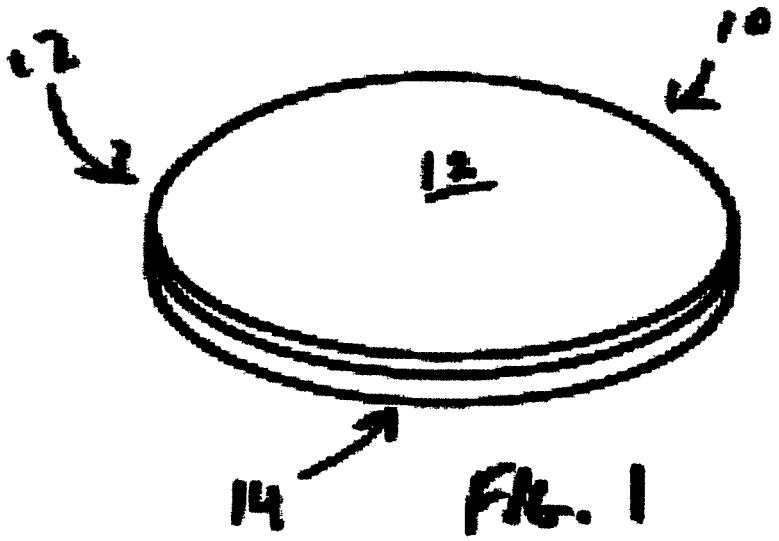
FIG. 1 is a perspective view of an exemplary furniture pad in accordance with the present disclosure.
Figure 2:
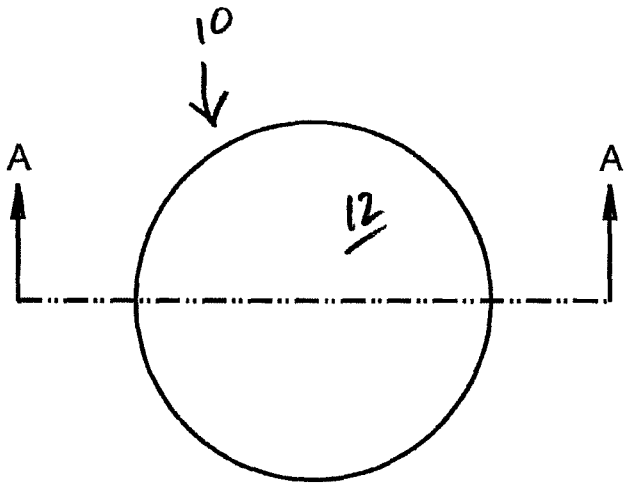
FIG. 2 is a plan view of the exemplary furniture pad of FIG. 1.

With reference to FIGS. 1 and 2, an exemplary furniture pad is illustrated and identified generally by reference numeral 10. The furniture pad 10 is generally round and has a domed or otherwise partially convex surface 12 adapted to engage a floor or other supporting surface, and a generally flat mounting surface 14 opposite the floor engaging surface adapted to engage or be secured to a leg or other supporting member of a piece of furniture or the like. Portions of the domed surface 12 and the mounting surface 14 reside in parallel planes. To this end, only a peripheral edge portion of the pad 10 is convex.

Figure 3:
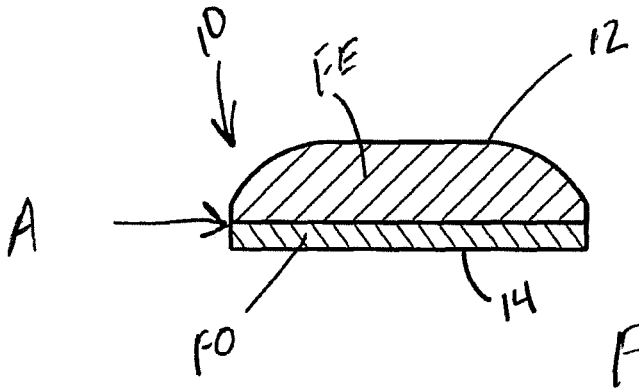
FIG. 3 is a cross-sectional view of the exemplary furniture pad taken along the line A-A in FIG. 3.

With further reference to FIG. 3, it will be appreciated that the exemplary furniture pad 10 is comprised of two materials, a felt material FE having the domed surface 12 and a foam material FO having the mounting surface 14. The felt material FE and the foam material FO can be joined together by a suitable adhesive A or the like. The felt material FE can be a synthetic felt or other suitable felt, for example. The foam material FO can be any of a wide variety of foams. While the present exemplary embodiment includes the foam material FO, it will be appreciated that some embodiments may not include foam.

Figure 4:
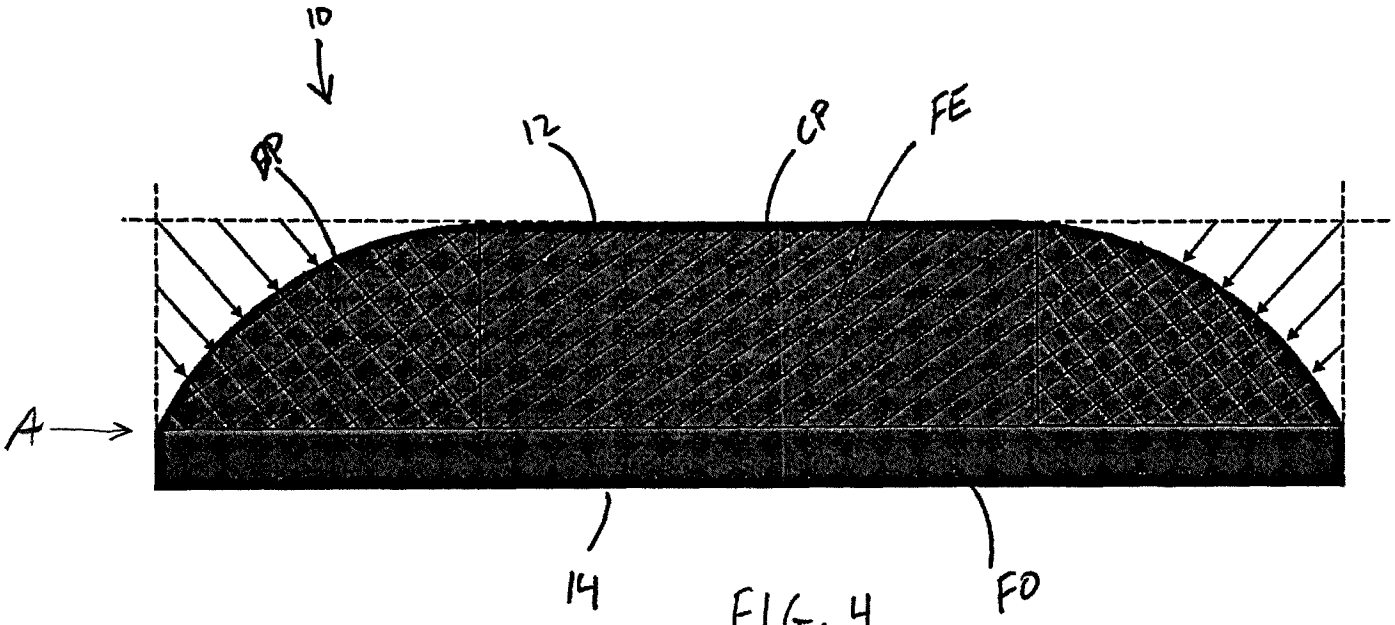
FIG. 4 is another cross-sectional view of the exemplary furniture pad illustrating the respective densities of certain portions of the furniture pad.

With additional reference to FIG. 4, the felt material FE of the present disclosure is configured with a relatively dense peripheral edge portion that has a greater resistance to abrasion and the like during use. To this end, the felt material FE has a dense peripheral edge portion DP (cross-hatched portion) thereof that is comprised of a compressed or otherwise densified portion of the felt material FE. The dense portion DP is generally annular and surrounds a central portion CP of the felt material FE. The dense portion DP in the illustrated embodiment is convex, but other shape profiles are also possible (e.g., beveled, etc.) In one embodiment, the dense portion DP is formed by applying heat and pressure to the felt material FE, which may have an initial cylindrical shape prior to the peripheral edge portion being compressed. Once the peripheral portion has been exposed to heat and pressure, the felt material FR, upon cooling, retains its densified condition. In some embodiments, the felt material of the dense portion DP can be 10%-100% more dense than the felt material of the central portion CP, and often 20%-80% more dense.

It should be appreciated that the dense portion DP of the present exemplary embodiment does not typically engage the floor or other supporting surface during use of the furniture pad 10. Instead, the convex shape of the dense portion DP results in the central portion CP being the primary (flat) floor engaging surface of the furniture pad 10. During sliding movement of furniture outfitted with the furniture pad 10, irregularities in the floor surface (cracks, transition strips, etc.) may result in the dense portion DP contacting the floor surface during movement of furniture. Such contact can be under enhanced stress since the momentum of the furniture during sliding may result in a significant force being applied to the dense portion DP when it contacts an irregularity or the like.

It should be appreciated that the densified felt of the dense portion DP is able to better withstand abrasion or other damage from such contact because it is convex and more durable than felt that has not been densified (e.g., the central portion CP). Meanwhile, the central portion CP remains the primary, relative soft and non-abrasive surface in contact with the floor during typical use.

The exemplary furniture pad 10 can further include an adhesive layer and paper backing (not shown) disposed on the generally flat mounting surface 14 for facilitating mounting to a furniture leg or the like.

In some embodiments, the dense portion DP can have varying density. For example, the outer peripheral edge can be least/most dense, with radially inner portions of the dense portion DP can be more/less dense.

As used herein, the term density includes the volumetric mass density of the felt. In other words, the density includes the mass per unit volume of the felt. As will be appreciated, portions of the felt having a greater density are relatively more dense than portions of the felt having a lesser density.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A furniture pad for use between a support member of an associated furniture item and an associated supporting surface, the furniture pad comprising:

a body having a floor engaging surface portion for engaging the associated supporting surface, and a peripheral edge portion at least partially surrounding the floor engaging surface portion, the peripheral edge portion having a first density and the floor engaging surface portion having a second density, the first density being greater than the second density, wherein the peripheral edge portion extends away from the floor engaging surface portion such that the peripheral edge portion does not contact the associated supporting surface when the floor engaging surface portion is in contact with the associated supporting surface, whereby the peripheral edge portion has a relatively more durable surface as compared to the floor engaging surface;

wherein at least a portion of the peripheral edge portion is convex; and wherein the body is composed of a unitary piece of felt having said first and second densities.

2. The furniture pad of claim 1, wherein the felt body is composed of synthetic fibers and has a maximum thickness at a central portion of 3 mm or more.

3. The furniture pad of claim 1, further comprising a foam pad secured to the body on an opposite side than the floor engaging surface portion.

4. The furniture pad of claim 1, wherein the peripheral edge portion is heat treated.

5. The furniture pad of claim 1, wherein the peripheral edge portion is more than twice as dense as the floor engaging surface portion.

6. A method of making a furniture pad for use between a support member of an associated furniture item and an associated supporting surface comprising providing a felt body having a uniform first density, the felt body having a first shape including a floor engaging surface portion and a peripheral edge portion at least partially surrounding the floor engaging surface portion, and applying at least one of heat or pressure to at least the peripheral edge portion to increase a density of the felt body such that the peripheral edge portion has a second density, the second density being greater than the first density, whereby the felt body has a second shape different than the first shape after applying at least one of heat or pressure to the peripheral edge portion.

7. The method of claim 6, further comprising shaping the peripheral edge portion to a predetermined profile while applying at least one of the heat or pressure.

8. The method of claim 7, wherein the shaping includes forming the peripheral edge portion into a convex shape.

* * * * *